US007156947B2

(12) United States Patent
Golzarian

(10) Patent No.: US 7,156,947 B2
(45) Date of Patent: Jan. 2, 2007

(54) ENERGY ENHANCED SURFACE PLANARIZATION

(75) Inventor: Reza M. Golzarian, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 251 days.

(21) Appl. No.: 10/883,396

(22) Filed: Jun. 30, 2004

(65) Prior Publication Data

US 2006/0000807 A1 Jan. 5, 2006

(51) Int. Cl.
*C23F 1/00* (2006.01)
*B44C 1/22* (2006.01)

(52) U.S. Cl. ..... 156/345.12; 156/345.13

(58) Field of Classification Search ..... 134/902; 156/345.12, 345.13, 345.16, 345.25
See application file for complete search history.

(56) References Cited

U.S. PATENT DOCUMENTS 6,406,641 B1 6/2002 Golzarian
6,419,553 B1 7/2002 Koinkar et al.
6,667,238 B1 * 12/2003 Kimura et al. ..... 438/692
6,808,590 B1 * 10/2004 Gotkis et al. ..... 156/345.16
6,875,086 B1 4/2005 Golzarian et al.
2001/0039175 A1 11/2001 Golzarian et al.
2002/0009953 A1 * 1/2002 Swanson ..... 451/53
2002/0013124 A1 * 1/2002 Tsujimura et al. ..... 451/138
2002/0173235 A1 11/2002 Koinkar et al.
2003/0119427 A1 * 6/2003 Misra ..... 451/41
2004/0106361 A1 6/2004 Golzarian et al.
2004/0166785 A1 8/2004 Golzarian et al.
2005/0070096 A1 3/2005 Golzarian et al.
2005/0112852 A1 5/2005 Golzarian

OTHER PUBLICATIONS

Diagnostic Imaging: Ultrasound taken from www.antonine-education.co.uk.*
NDT Resource Center, Eddy Currents from www.ndt-ed.org.*

* cited by examiner

*Primary Examiner*—Parviz Hassanzadeh
*Assistant Examiner*—Sylvia R. MacArthur
(74) *Attorney, Agent, or Firm*—Schwabe, Williamson & Wyatt, P.C.

(57) ABSTRACT

A substrate processing apparatus equipped to employ an energy directed at a process side of a substrate to enhance and control material removal is provided.

22 Claims, 4 Drawing Sheets

ENERGY ENHANCED SURFACE PLANARIZATION

FIELD OF THE INVENTION

Embodiments of the present invention relate to apparatus and methods for chemical mechanical planarization (CMP), and more particularly, to enhanced CMP in e.g. a semiconductor device manufacturing process through the use of energy forms such as eddy currents and/or acoustical energy.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Embodiments of the present invention relate the processing of substrates using energy forms, such as eddy currents and acoustic energy directed toward the process side of a substrate, in conjunction with a CMP process to enhance and control material removal. CMP processes complemented with eddy currents and/or acoustical energy may help to process e.g. semiconductor substrates more reliably, consistently, and uniformly during the planarization, conditioning and/or cleaning process. Embodiments of the present invention may allow for processing of a substrate using, for example, very low pressures, high rotational velocity, and manipulation of other parameters that may be particularly useful for planarization of ultra low-K dielectric materials to prevent mechanical damage during the substrate processing operation.

Embodiments in accordance with the present invention may be applicable to both the polishing and planarizing of substrates, such as semiconductor wafers, as well as the conditioning of processing elements, such as polishing pads. Embodiments in accordance with the present invention may be used with a variety of substrate processing tools/apparatus configurations, including for example, configurations that use single or multiple processing elements, such as polishing pads or conditioning pads. As used herein, processing elements may include, but are not limited to, polishing pads and conditioning pieces having a variety of configurations, geometries and sizes.

In embodiments of the present invention where the process is planarization or polishing of substrates, the substrate may be any suitable type of material such as semiconductor wafers, metalized layers in semiconductor devices, microelectromechanical systems (MEM) etc. And, in embodiments pertaining to conditioning of polishing pads, the polishing pads themselves may be considered a substrate being processed. It is therefore understood and appreciated that example methods and apparatuses illustrated herein that are described in terms of the planarization/polishing of substrates may be substantially applicable to the conditioning and/or cleaning processes.

Figure 1:
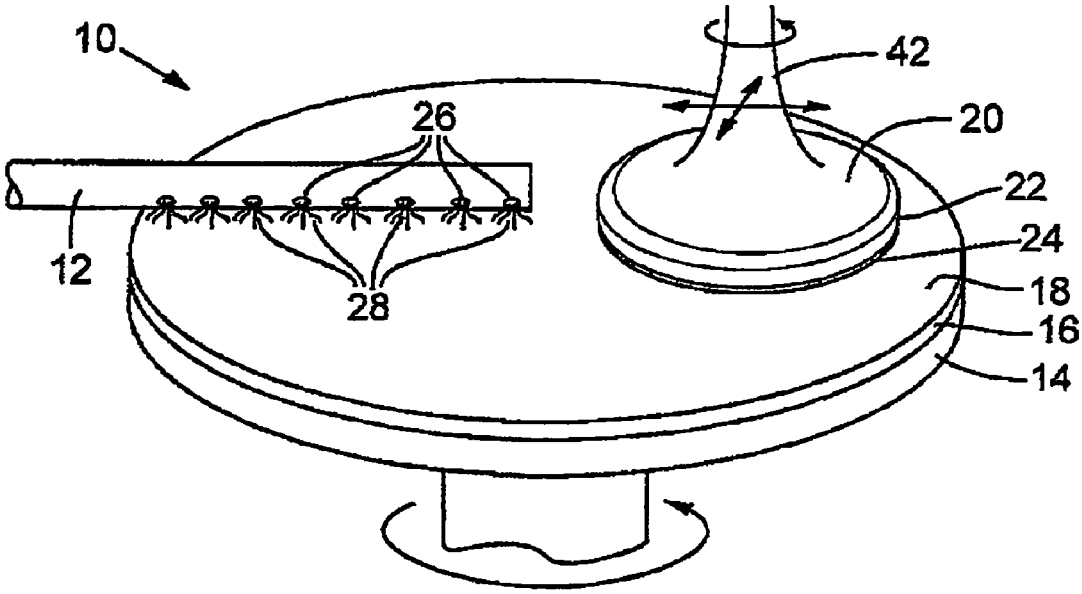
FIG. 1 illustrates a perspective view of a substrate processing apparatus in accordance with an embodiment of the present invention.

FIG. 1 illustrates a perspective view respectively of a substrate processing apparatus in accordance with an embodiment of the present invention. A CMP apparatus 10, may include a slurry/solution delivery system 12, a processing element 16 and a processing element carrier 14. Processing element 16 may be, for example, a polishing pad and the processing element carrier 14 may be a rotatable platen adapted to provide a substantially planar turntable to support a processing element 16.

Substrate carrier 20 may be configured to support a substrate 22 in substantially opposing relationship with the processing element 16. Substrate carrier 20 may be adapted to movably position the substrate 22 in urging engagement with the processing element 16 to effect a polishing pattern with the process side 24 of the substrate 22 on the surface 18 of the processing element 16. Substrate carrier 20 may be configured to rotate, oscillate, or otherwise move as needed to induce processing of the process side 24 of substrate 22 that may need to be planarized, polished, conditioned and/or cleaned.

Slurry delivery system 12 may include one or more nozzles 18 positioned adjacent the surface 26 for the dispensing of a slurry/solution 28 thereon. During a polishing/planarization step, for example, a slurry 28 containing e.g. a liquid, such as, but not limited to, deionized water for oxide polishing and a pH adjuster, such as potassium hydroxide also for oxide polishing, can be supplied to the surface 18 of processing element 16 by the slurry arm 12, and may help facilitate removal of material from process side 24 of substrate 22 during CMP. Slurry 28 can also include abrasive particles, such as, but not limited to, silicon dioxide for oxide polishing.

Figure 2:
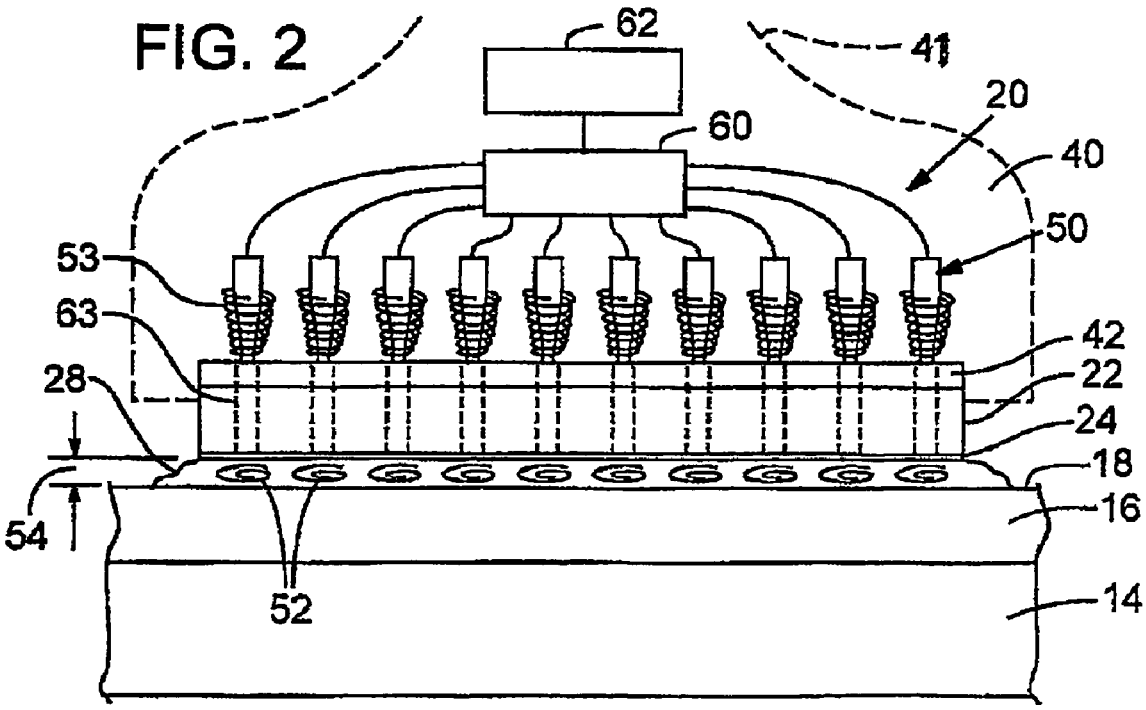
FIG. 2 illustrate a cross-sectional view of a substrate processing apparatus in accordance with an embodiment of the present invention.

FIG. 2 illustrates an enlarged cross-sectional view of a substrate processing apparatus in accordance with an embodiment of the present invention. The substrate carrier 20 may include a housing 40 and a drive shaft 41. Housing 40 may include a backing plate 42 for coupling with the backside of substrate 22. Substrate 22 may have a layer on process side 24 that needs to be removed and/or planarized. The process side 24 of substrate 22 may be positioned opposing the surface 18 of processing element 16 carried by processing element carrier 14. A slurry/solution may be disposed between the process side 24 and the surface 18 of the processing element. Embodiments of the present invention may include a small gap 54 being present between process side 24 and surface 18, as well as direct contact with no gap 54.

One or more energy sources, such as eddy current sources 50 may be configured in an array and positioned in substrate carrier 20, adjacent the backing plate 42. Eddy current sources 50 may be coupled to an electricity source 60, which may be part of the substrate carrier 20. In embodiments of the invention, electricity sources may be any suitable current source and may either be alternating or direct current. In other embodiments of the present invention the electricity source is not included within substrate carrier 20, but may be remotely positioned.

Eddy current sources 50 may be configured to induce and establish eddy currents 52 at the surface of process side 24 and within the slurry 28. The action of the eddy currents 52 in conjunction with the chemical and mechanical forces applied between the substrate carrier 20 and processing element 16, may urge the material of process side 24 to be removed, resulting in the planarization/polishing of substrate 22. The eddy currents may be pulsed or applied through a continuous mode of current input. In one embodiment, the eddy currents 52 may increase the temperature through induction heating of the process side 24 and the slurry 28 and excite the particles therein. This in turn may assist in the removal of material from the process side 24 of substrate 22.

Eddy currents 54 may be generated by eddy current sources 50, which may take a variety of forms and configurations known to those of skill in the art. In one embodiment in accordance with the present invention, the eddy current sources 50 may include a drive coil 53 surrounding a conductive material and coupled to a alternating current source. Flow of current though the coil 53 may generate a magnetic field, which when in close proximity to the substrate surface may induce circulating currents. An oscillator may be connected to the drive coil 53 to generate an oscillating magnetic field 63 that passes through the backing plate 42 and substrate 22 toward the process side of substrate 22 to thereby affect an eddy current 52 at the surface of process side 24. Eddy currents 52 may also be induced in slurry/solution 28 within the gap 28.

In embodiments of the present invention, where the slurry/solution 28 is electrolytic, the eddy current 52 and the slurry chemistry may stimulate removal of material from process side 24 of substrate 22 through electrochemical interaction between the processing element 16 and the substrate 22, and particularly the metal components of the process side 24. Suitable electrolytic polishing solution/slurry chemistries include, but are not limited to, acid(s) and/or base(s), pH stabilizing agents, chelating agents, oxidizers, metal ions (e.g. $CuSO_4$), inhibitors, surfactants, abrasives and polymers.

The magnitude of eddy current 52 may be controlled, e.g either increased or decreased, across the entire or selected locations of the process side of the substrate, in accordance with the desired degree of material removal. As the desired degree of material removal is approached, for example, the current supplied to the eddy current sources 50 by electricity source 60 may be reduced, such that the eddy current 52 may likewise be decreased or discontinued all together. When decreased or discontinued, the affect of the eddy currents on the material to be removed is decreased, and thus may increase the role of the chemical and mechanical components of the process in planarizing substrate 22.

In one embodiment of the present invention, the signal generation to each eddy current source 50 from electricity source 60 may be variably controlled by a controller. A suitable controller may include, but is not limited to, a computer having a CPU, memory, buses, I/O ports, all suitably interconnected to the electricity source 60. The controller may independently and variably control the magnitude of the eddy currents 52 depending on the amount of planarizing that has taken place (at selected locations), which may be indicated by e.g. an amount of material removed, to be described more fully below.

Operating parameters, such as slurry chemistry and magnitude of the eddy current from the initial to final stages of processing may be empirically determined depending upon the composition of the process side 24 of substrate 22.

Figure 3:
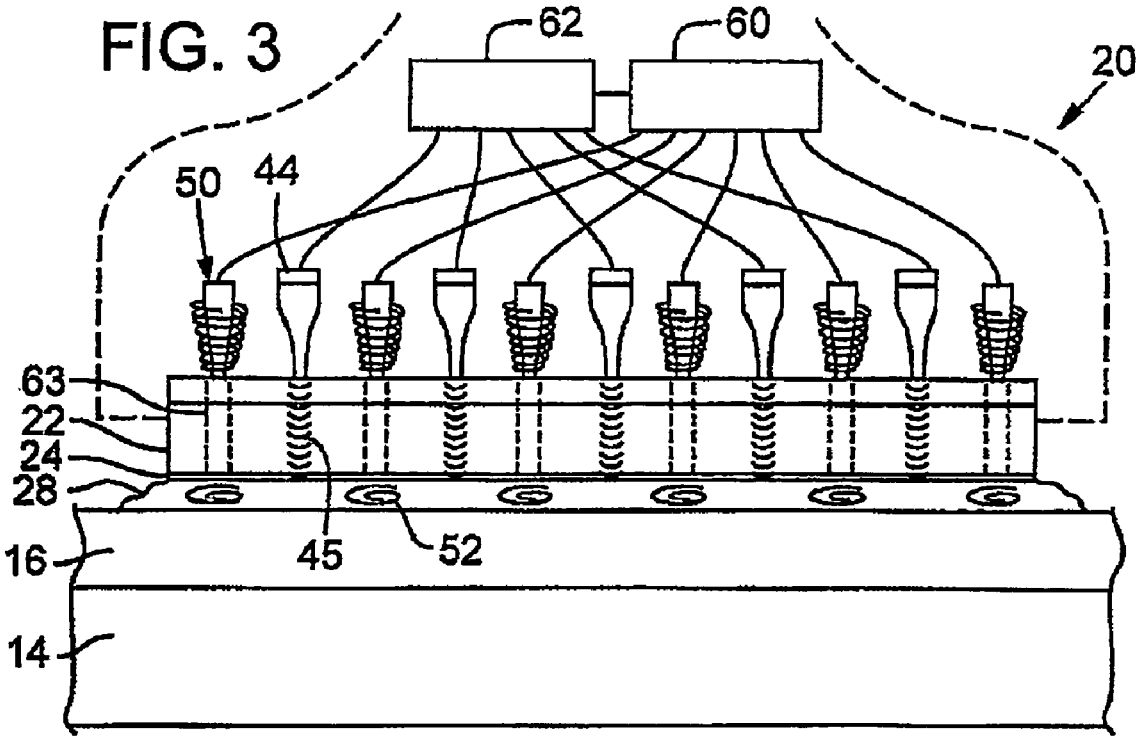
FIG. 3 illustrates a cross-sectional view of a substrate processing apparatus in accordance with an embodiment of the present invention.

FIG. 3 illustrates an enlarged cross-sectional view of a substrate processing apparatus in accordance with an embodiment of the present invention. Substrate 22 may be positioned in substrate carrier 20 for processing of process side 24 through energy enhance CMP. Eddy current sources 50 may be coupled to an electricity source 60 and configured to direct an energy toward the process side 24 of the substrate. A plurality of endpoint detectors 44 may also be positioned within substrate carrier 20 to monitor the processing of process side 24 and generate signals corresponding to the amount of material that has been removed therefrom (to e.g. indicate an amount of planarization performed, as alluded to earlier). Any suitable endpoint detection mechanism can be used to determine the amount of material removed, degree of planarization, and the like. For example, endpoint detectors may be optical (e.g. infra-red), electrical, acoustic or chemically based. Once the endpoint is reached (e.g. the desired amount of process side 24 has been removed or planarized), the magnitude of any one or all of the eddy currents 52 may be reduced and/or stopped.

In one embodiment of the present invention, endpoint detectors 44 may be interspersed between eddy current sources 50 and configured to detect the amount of material that has been removed or planarized from process side 24. End point detectors 44 may include a sound wave generator adapted to transmit and receive sound waves 45, in particular, low frequency sound waves, similar to processes used in a sound navigation and ranging (SONAR) system. End point detectors 44 may be coupled to controller 62, which may be adapted to receive and process signals from the endpoint detectors 44.

Controller 62 may also be in communication with eddy current sources 50 through electricity source 60, and configured to variably control the current to the eddy current sources 50. This in turn may allow for control of the magnitude of the eddy currents 52 generated based on the amount of material removed from process side 24 as detected by the endpoint detectors 44.

In other embodiments of the invention, the controller and electricity source may be a single component, and may be part of the substrate carrier or may be positioned at a different location in the processing tool. In other embodiments of the present invention, the eddy current source and the sound wave generator or other endpoint detector may be a single device adapted to not only generate an eddy current, but also to detect the amount of material that has been removed from the process side of the substrate.

Figure 4:
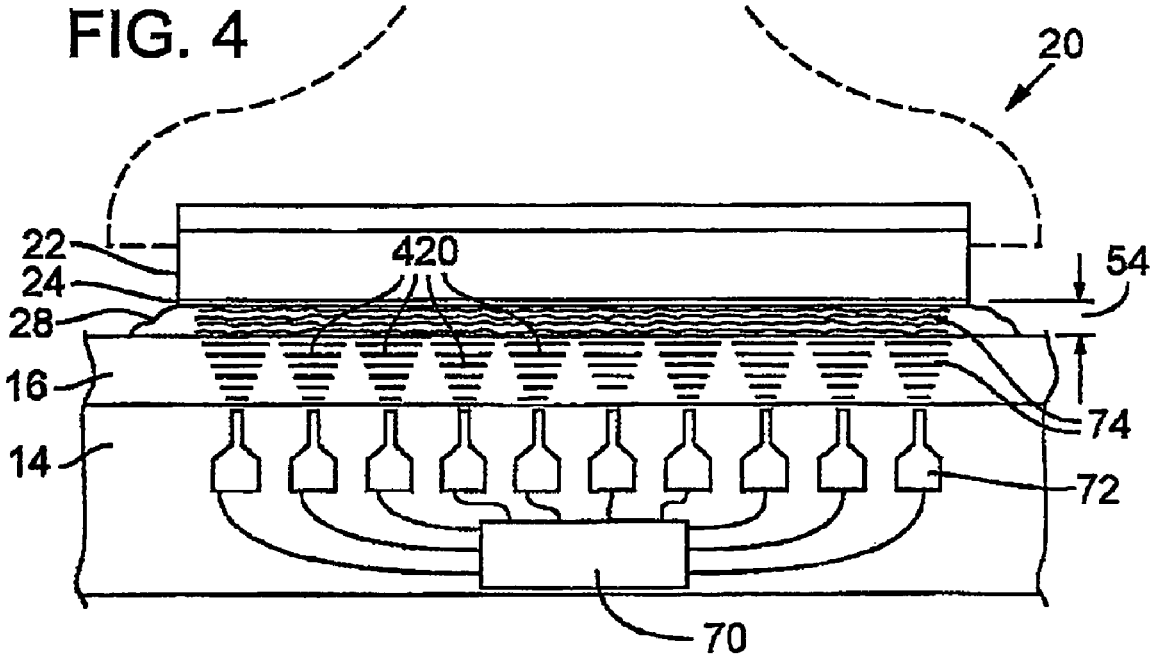
FIG. 4 illustrates a cross-sectional view of a substrate processing apparatus in accordance with an embodiment of the present invention.

FIG. 4 illustrates a cross-sectional view of a substrate processing apparatus in accordance with an embodiment of the present invention. A substrate 22 may be controllably positioned in a processing configuration (i.e. process side facing the surface of processing element 16) opposite a processing element 16 and processing element carrier 14. An acoustic energy generator 70 may be disposed in the processing element carrier 14, which may be adapted to carry processing element 16 (e.g. a polishing pad or a conditioning pad).

The acoustic energy generator 70 may be coupled to an array of acoustic energy sources 72, such as acoustic transducers. Acoustic energy sources 72 may be positioned within the processing element carrier 14 and configured to transmit acoustic energy 74 through processing element 16 towards process side 24 of substrate 22. Acoustic energy 74 may induce both a temperature and energy increase in the slurry 28 and at the process side 24 that is to be removed. The heat and energy increase may be due in part to a vibratory state generated by the acoustic energy. The magnitude of the acoustic energy, and thus the vibratory state may be increased and decreased globally across the process side of the substrate or locally at certain areas to increase or decrease the amount of material removal. The acoustic energy 74 thus may provide, among other things, enhanced material removal from layer 22, in order to reduce the dependence on the chemical and mechanical elements of the substrate processing.

Acoustic energy sources 72 can take a number of forms and configurations. In one embodiment of the present invention, acoustic energy sources may be positioned in the substrate carrier and adapted to generate and transmit acoustic energy through the substrate, in the form of a vibration. The acoustic energy may energize the particles on the layer to be planarized and thus enhances planarization by urging more effective interaction with the chemical slurry and the processing elements, which may in turn enhance material removal. In one embodiment the acoustic energy may be a single frequency, or may be of multiple frequencies and may also be selectively tunable.

In another embodiment of the present invention, acoustic energy sources may be used in conjunction with an endpoint detection device. A controller may be in communication therewith and when a certain degree of processing has been achieved, the controller may variably decrease the magnitude of the acoustic energy transmitted in order to reduce the amount of acoustically enhanced CMP that may be taking place in a certain area. Likewise, if a particular area is not planarizing appropriately, the magnitude of the acoustical energy may be increased in a localized area to further enhance the acoustical CMP.

Figure 5:
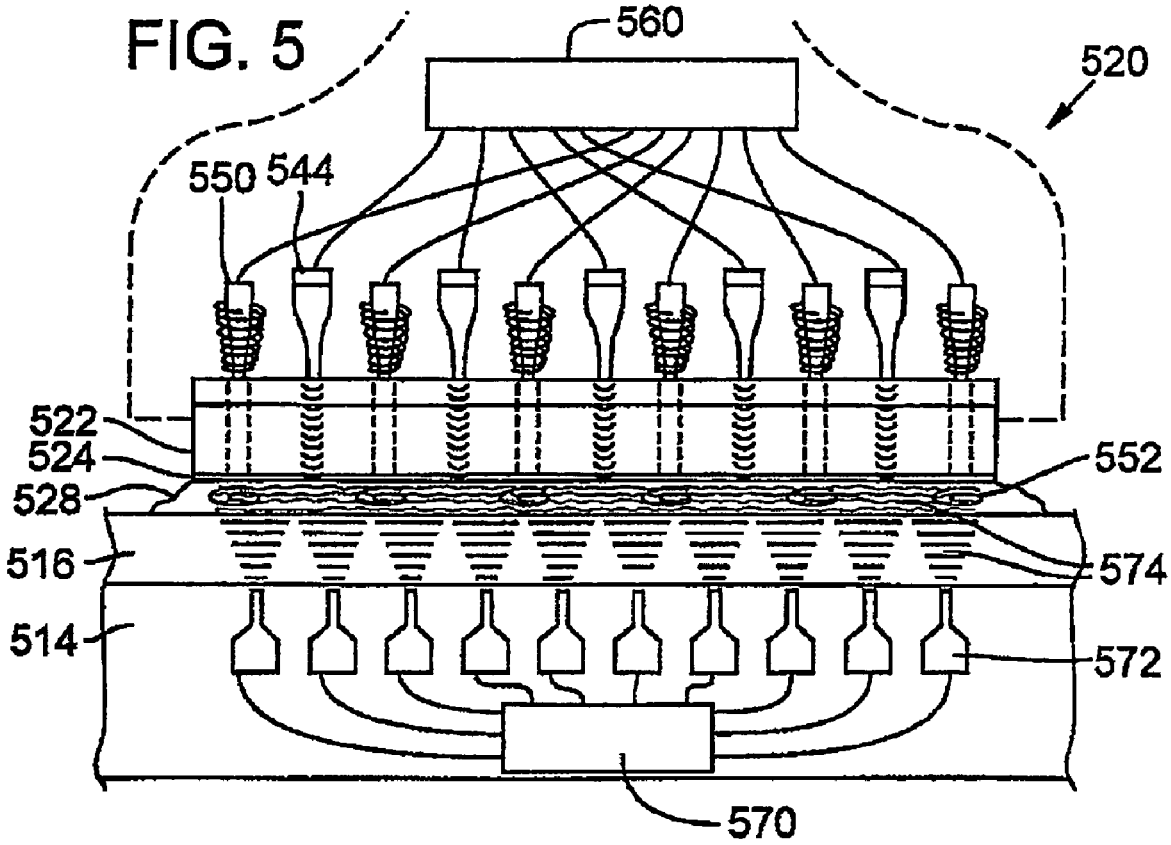
FIG. 5 illustrates a cross-sectional view of a substrate processing apparatus in accordance with an embodiment of the present invention.

FIG. 5 illustrates a cross-sectional view of a substrate processing apparatus in accordance with an embodiment of the present invention. A substrate carrier 520 may be configured to hold a substrate 522 in position for processing a process side 524. Process side 524 may be opposably facing a processing element 516 carried by processing element carrier 514. A slurry/solution 528 may be disposed between the process side 524 and processing element 516 to chemically facilitate material removal from process side 524.

Substrate carrier 520 may have a plurality of eddy current sources 550 positioned therein and configured to generate an eddy current 552 at the process side 524 of substrate 522, as well as and in the slurry/solution 528. The generation of eddy currents 552 may enhance or urge the removal of material from process side 524 through heat generation and electrically exciting the particles of process side 524.

Processing element carrier 514 may include an acoustical energy generator 570 in communication with a plurality of acoustical transducers 572. Acoustical transducers may be configured to transmit acoustical energy 574 towards process side 524 through the processing element 516 and into the slurry/solution 528. Acoustical energy 574 may generate heat and vibrations that may affect process side 524, and may urge removal of material therefrom.

An endpoint detection device 544 may be used to monitor and sense the amount of process side 524 that has been removed. Endpoint detection device 544 may be in electrical communication with an eddy current controller 560, which controls the energy sent to the eddy current sources 550. Endpoint detection device may also be in electrical communication with acoustic energy generator 570, which controls the amount of acoustical energy transmitted by acoustic energy sources 572. Based on the amount of processing in which the process side 524 has undergone, eddy current controller 560 and acoustical energy generator 570 may variably control the magnitude of the eddy current 552 and acoustic energy 570 that affects various portions of the process side 524.

In one embodiment of the present invention, the temperature may be modulated at certain localized areas of the processing side such that a temperature difference may be caused within a limited local area or from one area to another area of the process side. The process side temperature may be controlled across localized areas by independently and individually or collectively controlling the temperature modulation, which in turn may selectively enhance local material removal rate.

The temperature may be modulated in a variety of ways, including employing a thermal energy source that may increase or decrease the temperature at one or more localized locations or groups of localized locations. For example, the thermal energy source may be optically induced (e.g. infrared laser) or electrically induced (e.g. a thermal resistor). Other thermal energy sources or methodologies may used, such as a heat sink or other thermal energy transfer device. In one embodiment, the thermal energy source may be configured to affect the process side directly via passages in the backing plate, for example, or may be transferred through the backing plate by radiation or other thermal energy transfer property. In one embodiment of the invention, the thermal energy sources may also be positioned in the process element carrier.

Figure 6:
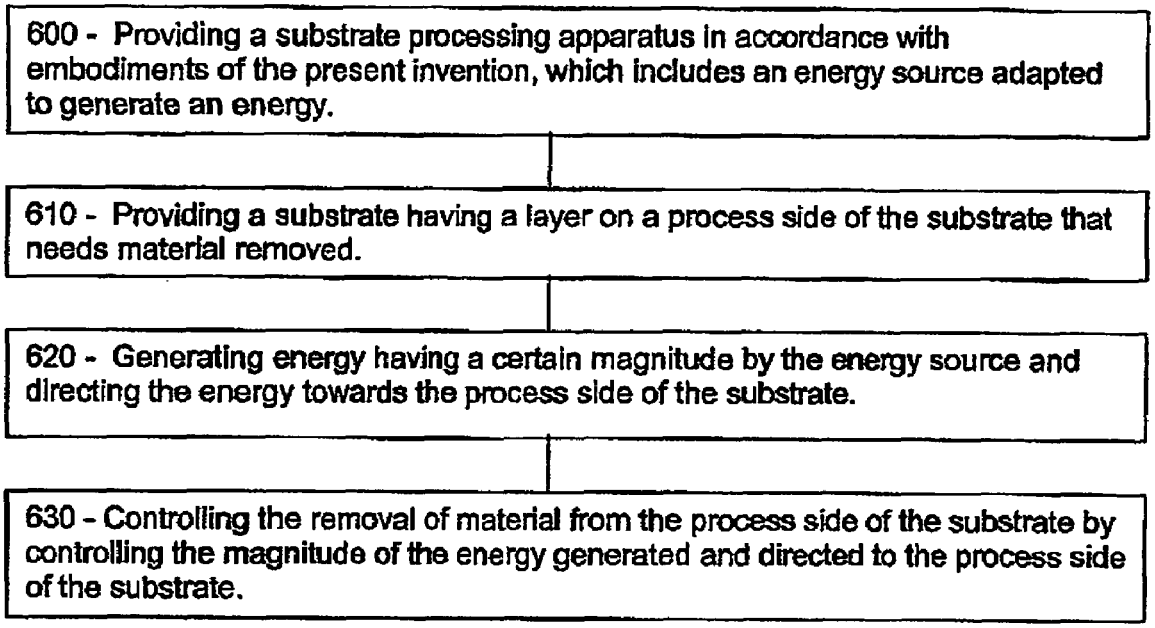
FIG. 6 illustrates a method of enhancing CMP using an energy source in accordance with and embodiment of the present invention.

FIG. 6 illustrates a method of enhancing CMP using an energy source in accordance with and embodiment of the present invention. A substrate processing apparatus may be provided in accordance with embodiments of the present invention, which includes an energy source adapted to generate an energy (600). A substrate may be provide having a layer on a process side of the substrate that needs material removed (610). Energy having a certain (varying or uniform) magnitude may be generated by the energy source and directed towards the process side of the substrate (620). Material from the process side of the substrate may be selectively removed by controlling the magnitude of the energy generated and directed to the process side of the substrate (630).

Embodiments of the present invention may allow for the energy source, such as the eddy current sources, acoustic energy source, thermal energy sources and the like, to be positioned in either the substrate carrier, or the processing element carrier or both. Further, the energy sources described herein, as well as others, may be individual separate devices, or more than one energy sources may be configured within one device. For example, a single energy source my include an eddy current source, an acoustic energy source and a thermal energy source. Further, the number and positioning of the energy sources may be modified based on several processing factors, including, but not limited to, substrate size, material, processing stage, and the like. The energy sources may be manufactured in a number of ways. In one embodiment, the energy sources may be manufactured by micro machining technology and methodologies, such as Micro Electro Machining Systems.

As discussed earlier, embodiments of the present invention may apply to enhancing both the chemical and mechanical planarization/polishing process, as well as the conditioning of processing elements prior to, during or after the processing elements have clogged with debris from the planarization process. Embodiments in accordance with the present invention may also be used in conjunction with electrically enhanced CMP.

Also, though certain substrate processing tool configurations were illustrated, embodiments of the present invention may also be applied to a number of different processing tool configurations and processes. Other tool configurations may include, but are not limited to, those having single processing elements, multiple processing elements, processing elements having simple and complex geometries, substrate holders having one or more electrically isolated regions, and/or multiple substrate holders.

The embodiments of apparatus and methods in accordance with the present invention may provide the ability to process larger semiconductor substrates more reliably, consistently and uniformly during the planarization process. The complementary use eddy currents and/or acoustical energy in conjunction with the CMP process may provide the ability to use very low pressures and very high rotational velocity, which is particularly useful for planarization of ultra low-K materials. Similarly, it also may help prevent metal delamination during the planarization process, which is caused by the weak adhesion between the low-K materials and the metal layer.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A substrate processing apparatus, comprising:

a substrate carrier configured to control a substrate for processing;

a processing piece adapted to hold a processing element and configured to facilitate mechanical and chemical interaction with a process side of the substrate; and one or more eddy current sources positioned within the substrate processing apparatus and configured to cause corresponding one or more eddy currents to be directed toward the process side of the substrate to urge removal of material from the process side, wherein at least one of the one or more eddy current sources is selectively controllable to vary a magnitude of the corresponding eddy current(s) based at least in part on an amount of material remaining to be removed from the process side.

2. The substrate processing apparatus of claim 1, further comprising one or more acoustic energy sources configured to generate acoustic energy and cause the acoustic energy to be directed toward the process side of the substrate to urge removal of material from the process side.

3. The substrate processing apparatus of claim 2, wherein the acoustic energy sources are selectively controllable to vary one or more magnitudes of the acoustic energy at one or more locations on the process side of the substrate.

4. The substrate processing apparatus of claim 3, wherein at least one of the one or more acoustic energy sources is an acoustic transducer.

5. The substrate processing apparatus of claim 2, wherein the acoustic energy generator is positioned within the processing piece.

6. The substrate processing apparatus of claim 1, wherein the one or more eddy current sources are positioned within the substrate carrier.

7. The substrate processing apparatus of claim 1, further comprising a controller in communication with the eddy current sources, the controller being configured to control the at least one of the eddy current sources to vary the magnitude of the corresponding eddy current(s).

8. The substrate processing apparatus of claim 7, further comprising one or more endpoint detection devices for monitoring the process side of the substrate during processing, the endpoint detection devices being in communication with the controller, and the controller being adapted to receive an input from the endpoint detection devices representing the amount of material remaining to be removed from the process side of the substrate, and to vary the magnitude of the corresponding eddy current(s) based at least in part on the received input.

9. The substrate processing apparatus of claim 8, wherein at least one of the end point detection devices includes a sound wave generating device adapted to transmit and receive sound waves to detect the amount of material remaining to be removed from the process side.

10. The substrate processing apparatus of claim 1, further comprising a thermal energy source configured to generate thermal energy and cause the thermal energy to be directed toward the process side of the substrate to urge removal of material from the process side.

11. A substrate processing system, comprising:

a substrate carrier configured to control a substrate for processing;

a processing piece adapted to hold a processing element and configured to facilitate mechanical and chemical interaction with a process side of the substrate;

one or more eddy current sources adapted to cause corresponding one or more eddy currents to be directed toward the process side of the substrate to urge removal of material from the process side of the substrate, wherein at least one of the one or more eddy current sources is selectively controllable to vary a magnitude of the corresponding eddy current(s) based at least in part on an amount of material remaining to be removed from the process side;

a slurry delivery device adapted to dispense a slurry on the substrate to facilitate processing of the process side of the substrate;

at least one endpoint detection device configured to monitor the processing of the process side and adapted to generate input signals corresponding to the amount of material remaining to be removed from the process side of the substrate; and a controller adapted to receive the input signals from the at least one endpoint detection device and configured to control at least one of the one or more eddy current sources to vary the magnitude of the corresponding eddy current(s), based at least in part on the received input signals.

12. The substrate processing system of claim 11, wherein the one or more eddy current sources are positioned within the substrate carrier.

13. The substrate processing system of claim 11, wherein the one or more eddy current sources are coupled to an electricity source.

14. The substrate processing system of claim 11, further comprising an acoustic energy generator coupled to one or more acoustic energy sources, wherein the one or more acoustic energy sources are configured to generate acoustic energy and cause the acoustic energy to be directed toward the process side of the substrate to urge removal of material from the process side.

15. The substrate processing system of claim 14, wherein at least one of the acoustic energy sources is selectively controllable to vary a magnitude of the acoustic energy on the process side of the substrate.

16. The substrate processing system of claim 15, wherein the at least one of the acoustic energy sources is an acoustic transducer.

17. The substrate processing system of claim 11, wherein at least one of the end point detection devices includes a sound wave generating device adapted to transmit and receive sound waves to detect the amount of material remaining to be removed from the process side.

18. The substrate processing system of claim 11, further comprising a thermal energy source configured to generate the energy in the form of thermal energy and cause the thermal energy to be directed toward the process side of the substrate to urge removal of material from the process side.

19. A substrate processing method, comprising:

providing a substrate having a process side;

providing a substrate processing apparatus including a processing piece adapted to facilitate mechanical and chemical interaction with the substrate, a substrate carrier adapted to control the substrate during processing, and one or more eddy current sources configured to generate corresponding one or more eddy currents;

generating at least one corresponding one or more eddy current and causing the corresponding eddy current(s) to be directed toward the process side of the substrate; and selectively controlling removal of material from the process side of the substrate by varying a magnitude of at least one of the eddy currents based at least in part on an amount of material remaining to be removed from the process side.

20. The method of claim 19, further comprising generating an acoustic energy and directing the acoustic energy towards the process side of the substrate to urge removal of material therefrom.

21. The method of claim 19, wherein the selectively controlling of the removal of material includes reducing the magnitude of the at least one of the eddy currents to reduce the amount of material being removed from the process side of the substrate.

22. The method of claim 19, further comprising:

detecting the amount of material removed from the process side of the substrate; and generating input signals corresponding to the amount of material remaining to be removed from the process side of the substrate.

* * * * *

UNITED STATES PATENT AND TRADEMARK OFFICE

CERTIFICATE OF CORRECTION

PATENT NO. : 7,156,947 B2
APPLICATION NO. : 10/883396
DATED : January 2, 2007
INVENTOR(S) : Reza M. Golzarian It is certified that error appears in the above-identified patent and that said Letters Patent is hereby corrected as shown below:

Column 2
Line 49, "...nozzles 18...surface 26..." should read --...nozzles 26...surface 18...--.
Line 55, "...slurry arm 12, ..." should read --slurry delivery system 12, ...--.

Column 3
Line 32, "Eddy currents 54..." should read --Eddy currents 52...--.
Line 46, "...gap 28." should read --...gap 54.--.

Column 5
Line 23, "...layer 22, ..." should read --...substrate 22, ...--.

Column 6
Line 18, "...acoustic energy 570..." should read --...acoustical energy 574...--.

Column 10
Lines 11-12, Claim 19 "...one or more eddy current..." should read --...one or more eddy currents...--.

Signed and Sealed this

Fourth Day of November, 2008

JON W. DUDAS
*Director of the United States Patent and Trademark Office*